United States Patent [19]

Wolpert, Jr.

[11] Patent Number: 4,564,238

[45] Date of Patent: Jan. 14, 1986

[54] LEG-RESTS FOR MODIFIED WHEEL-CHAIR

[75] Inventor: George H. Wolpert, Jr., Colombia, Pa.

[73] Assignee: Spectro Industries, Inc., Jenkintown, Pa.

[21] Appl. No.: 538,209

[22] Filed: Oct. 3, 1983

[51] Int. Cl.[4] ..... A47C 7/50

[52] U.S. Cl. ..... 297/430; 297/440

[58] Field of Search ..... 297/430, 431, 432, 433, 297/435, 440

[56] References Cited

U.S. PATENT DOCUMENTS

| | | | |
|---|---|---|---|
| 2,609,864 | 9/1952 | Gates | 297/433 |
| 3,031,230 | 4/1962 | Roe et al. | 297/432 |
| 3,123,397 | 3/1964 | Murcott | 297/430 X |
| 3,158,398 | 11/1964 | Stryker | 297/440 X |
| 3,258,276 | 6/1966 | Murcott | 297/433 |
| 3,325,215 | 6/1967 | Murcott | 297/433 |
| 3,902,758 | 9/1975 | Piracek | 297/430 |

*Primary Examiner*—Francis K. Zugel

[57] ABSTRACT

An improved wheel chair foot/leg rest is disclosed that can be retro-fitted onto existing wheel chairs. A series of parallel tubes attach under the wheel chair seat, and house sliding tubes that carry a rotating foot/leg rest.

1 Claim, 6 Drawing Figures

LEG-RESTS FOR MODIFIED WHEEL-CHAIR

BACKGROUND OF THE INVENTION

1. Field of the Invention

The presently disclosed invention relates to wheel chairs and the like, and more particularly to leg- and foot-rests for wheel chairs and to a simple and easily manufactured foot/leg rest assembly that can be added to an already existing chair.

2. Description of the Prior Art

The evolution of wheel chairs has brought about many comforts to the chair occupant. It is known to construct a wheel chair with the added feature of a foot/leg-rest that can be moved from a storage position to a working position, and vice versa. Such a device is shown in U.S. Pat. No. 4,227,742 to M. I. Thomas. That invention utilizes a fixed extension of lower, horizontal tubes to carry a slidable leg-rest.

It is also known to provide an extendible foot-rest apparatus that can be stored underneath the chair and that can be inverted to provide a cushion arrangement by sliding the apparatus completely out of the carrying tubes and inverting it and then sliding it back into place. An invention such as this is shown in U.S. Pat. No. 3,325,215 to C. E. Murcott.

Other inventions provide selectively operable leg rests that can be folded flat against the side of the chair, and leg rests that are collapsible to facilitate folding the chair for transport or storage.

However, while the above-mentioned devices provide improved comfort to wheel chair occupants, there are shortcomings attendant with each.

SUMMARY OF THE INVENTION

A wheel chair leg/foot-rest assembly that may be attached beneath the seat of a wheel chair is disclosed. The assembly is made of spaced-apart parallel tubes rigidly braced by transversely disposed members that are adapted to hang from the wheel chair seat frame. Leg-rests are rotatably attached to telescopingly received inner tubes to be individually extended from a storage position underneath the seat to a leg/foot-rest position, with a catch arranged to secure said extension at discreet intervals.

OBJECTS OF THE INVENTION

It is an object of the invention to provide a leg/foot-rest assembly which maintains that proper dimensional relationships between the support and the leg rest of the user so that the lower leg and foot of the user are supported naturally and evenly in all adjusted positions without restricting blood flow throughout the leg.

Another object of the invention is to produce a leg assembly which may be attached to existing wheelchair frames without substantial modification thereof.

Another object of the invention is to provide a telescoping leg rest for wheel chairs that is supported by the chair frame.

Still another object of the invention is to produce a leg rest assembly for a wheel chair that is readily and economically manufactured.

These and other objects of this invention will appear from the following specification, and are not to be construed as limiting the scope of the invention thereto, since in view of the disclosure herein, others may be able to make additional embodiments within the scope of the appended claims.

DETAILED DESCRIPTION OF THE PREFERRED EMBODIMENT

Figure 1:
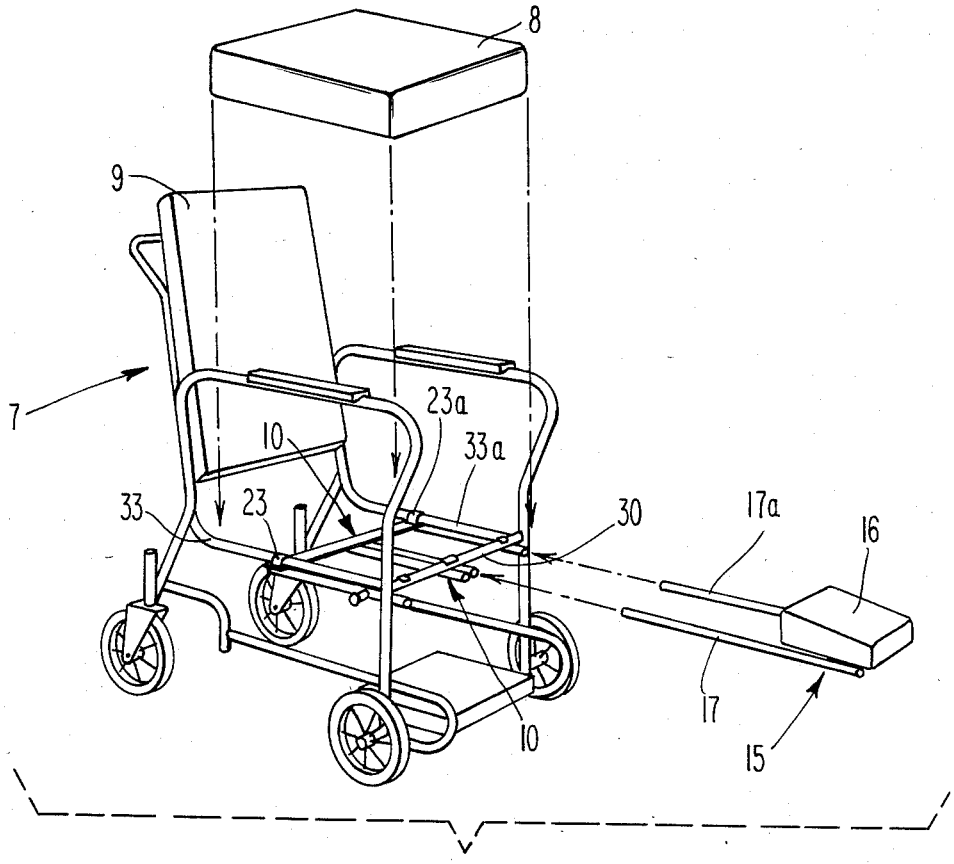
FIG. 1 shows an expanded, perspective view of a wheel chair with the invention attached.
Figure 2:
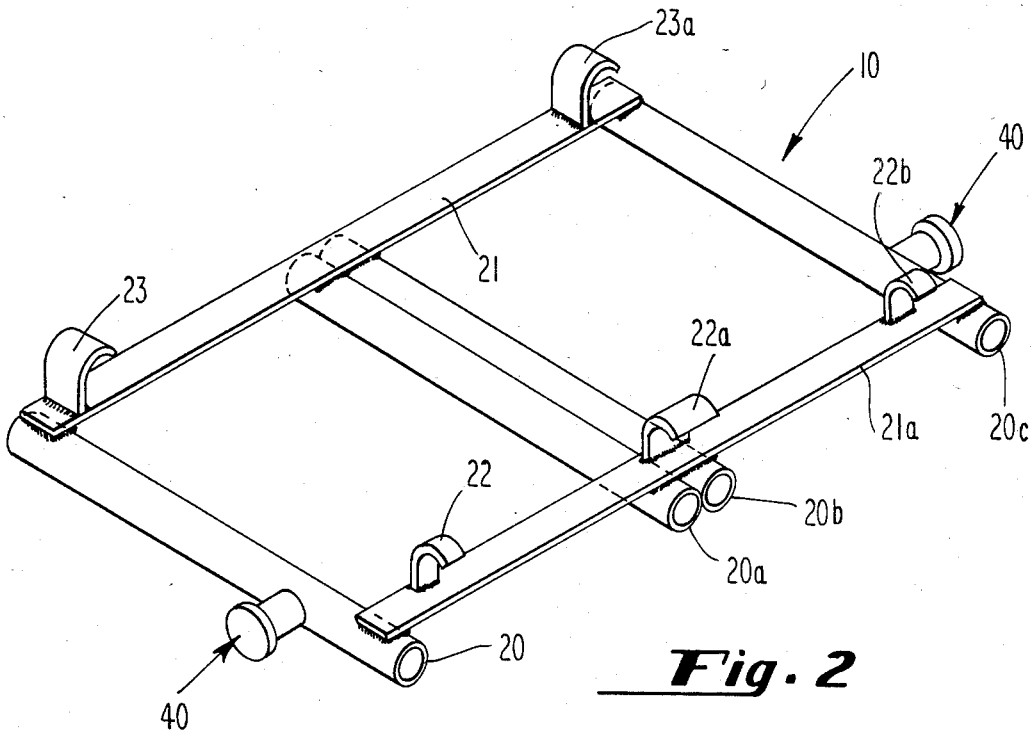
FIG. 2 shows a perspective view of the leg-rest receiving assembly of the present invention without the leg-rests attached thereto.
Figure 3:
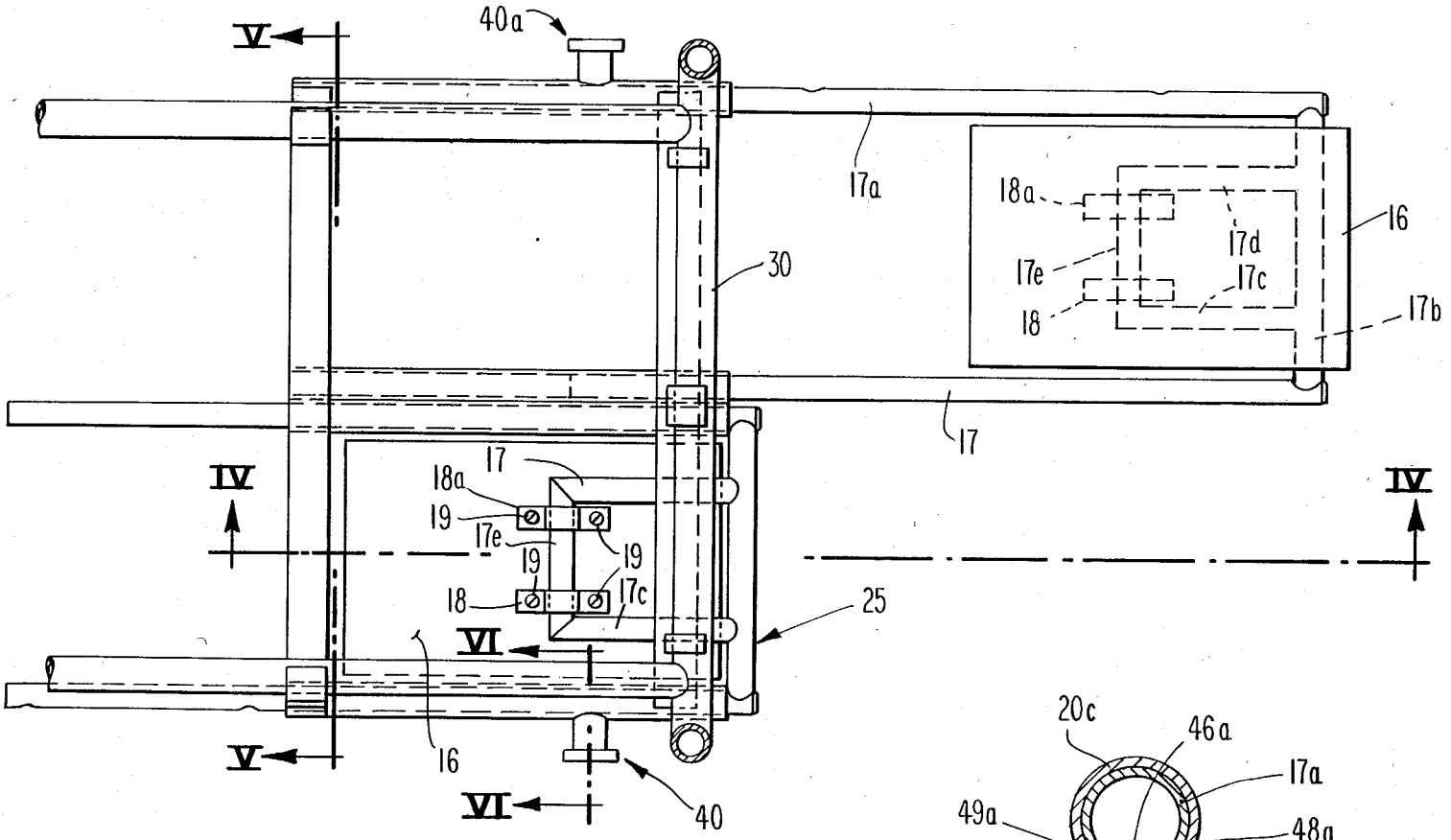
FIG. 3 shows a plan view of the present invention.

Referring now particularly to FIG. 1, 7 generally designates an existing wheel chair adapted, in accordance with this invention, with a leg-rest receiving assembly 10 and a plurality of leg-rest assemblies 15, 25 (as shown in FIG. 3). FIG. 2 depicts a leg-rest receiving assembly 10 as contemplated by this invention.

Leg-rest receiving assembly 10 consists of a plurality of spaced-apart, substantially parallel tubes 20, 20*a*, 20*b* and 20*c* of substantially equal length and lying in the same plane, said parallel tubes being attached immediately below, and rigidly braced by, transversely disposed members 21, 21*a*. Transversely disposed members 21 and 21*a* are situated above opposite ends of parallel tubes 20, 20*a*, 20*b* and 20*c*.

Parallel tubes 20, 20*a*, 20*b*, 20*c* are spaced such that, when wheel chair 7 is adapted with leg-rest receiving assembly 10 immediately below seat cushion 8, outer parallel tubes 20 and 20*c* approximately span the width of a human being when seated in wheel chair 7. Placement of inner parallel tubes 20*a*, 20*b* will be described below.

Figure 4:
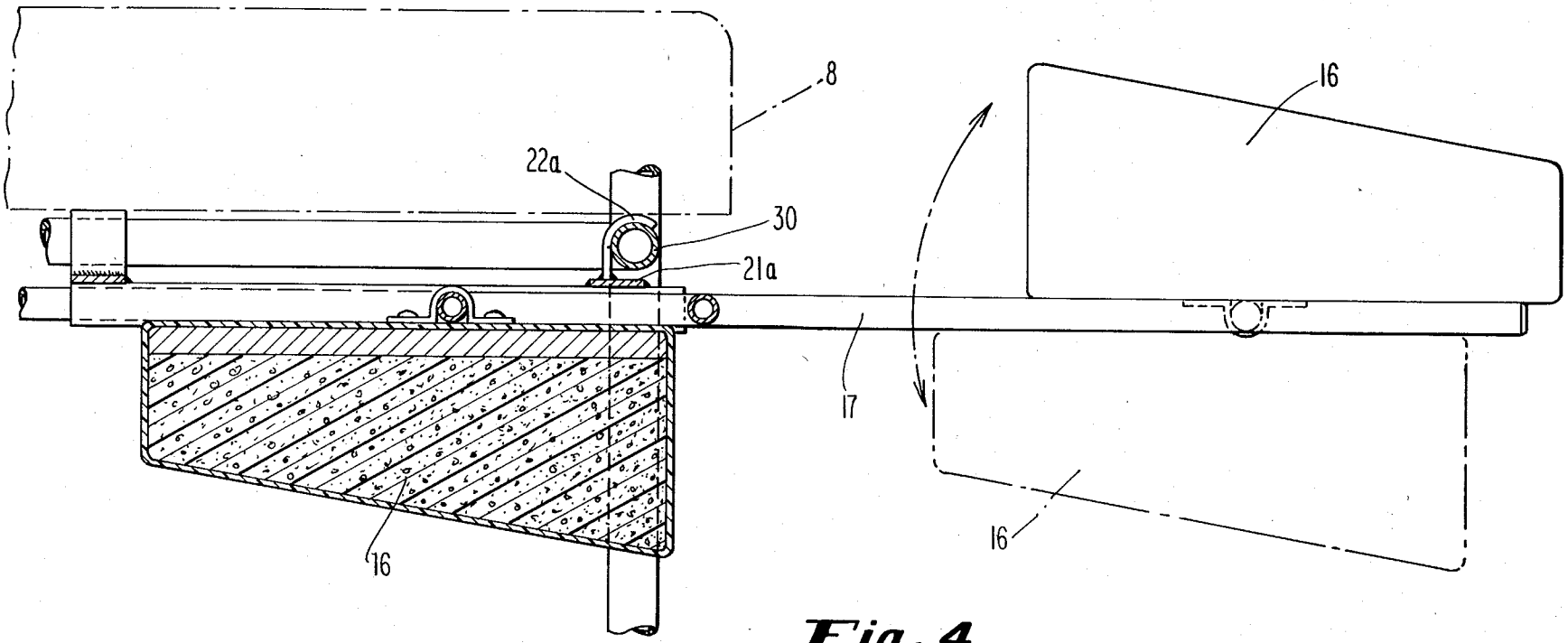
FIG. 4 shows a view taken along lines IV—IV of FIG. 3.

Brackets 22, 22*a* and 22*b* extend from and above the upper surface of transversely disposed member 21*a*. Transversely disposed member 21*a* is situated toward the end of leg-rest assembly 10 which is farthest from back cushion 9 of wheel chair 7 when wheel chair 7 is adapted with leg-rest receiving assembly 10. Brackets 22, 22*a* and 22*b* each have a curved section so as to hook onto the forward support bar 30 of the seat support frame of wheel chair 7 snugly and somewhat coaxially so that, when brackets 22, 22*a* and 22*b* are hooked onto forward support bar 30, transversely disposed member 21*a* sits somewhat below forward support bar 30, as shown in FIG. 4. Brackets 22, 22*a* and 22*b* either all curve forward of wheel chair 7, when wheel chair 7 is adapted with leg-rest receiving assembly 10, as shown in FIGS. 1, 2 and 4, or could be made to all curve rearward (not shown).

Brackets 23 and 23*a* extend from and above the upper surface of transversely disposed member 21. Transversely disposed member 21 is situated toward the end of leg-rest assembly 10 which is nearest back cushion 9 of wheel chair 7 when wheel chair 7 is adapted with leg-rest receiving assembly 10. Brackets 23 and 23*a* each have a curved section so as to hook onto side support bars 33 and 33*a* of wheel chair 7, respectively. Bracket 23 curves toward the same direction as does bracket 23*a* along a line perpendicular to the principal axes of parallel tubes 20, 20*a*, 20*b*, and 20*c*. The arc made by brackets 22, 22*a*, 22*b*, 23 and 23*a* is approximately 180 degrees, or a semi-circle.

To removably attach leg-rest receiving assembly 10, seat cushion 8 of wheel chair 7 is first removed. For a typical wheel chair, this may be accomplished by simply unscrewing screws which, in normal wheel chair usage, securely fasten seat cushion 8 to side support bars 33 and 33*a*. Leg-rest receiving assembly 10 is then slipped onto a seat frame as defined by side support bars 33, 33*a* and forward support bar 30 by placing the leg-rest receiving assembly 10 below said seat frame, and maneuvering the leg-rest receiving assembly such that brackets 23 and 23*a* slip over and grasp side support bars 33 and 33*a*, respectively, and brackets 22, 22*a* and 22*b* slip over and grasp forward support bar 30, as depicted in FIGS. 1 and 4. The curved sections of brackets 22, 22*a* and 22*b*, partially wrap around the upper surface of forward support bar 30 so as to hook onto, or grasp, forward support bar 30. See FIG. 4. Likewise, brackets 23 and 23*a* partially wrap around the upper surface of side support bars 33 and 33*a*, respectively, so as to hook onto, or grasp, side support bars 33 and 33*a*. The partial wrapping of the brackets form lips which prevent substantial horizontal movement of leg-rest receiving assembly 10 with respect to the seat frame unless there is, additionally, vertical movement of leg-rest receiving assembly 10 with respect to the seat frame.

Figure 5:
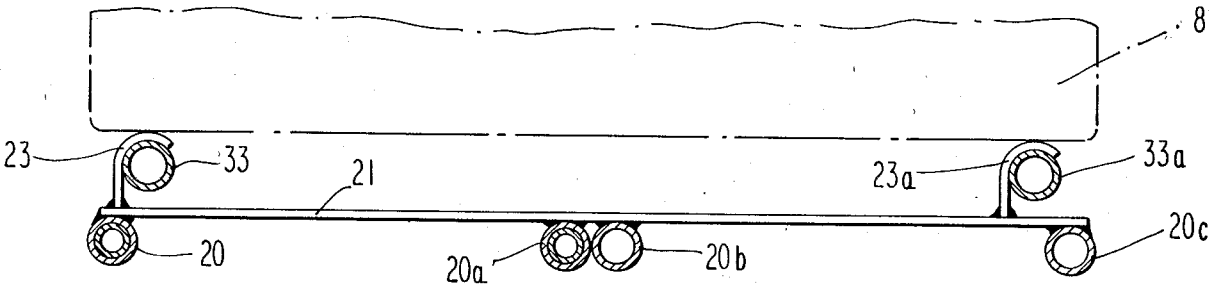
FIG. 5 shows a view taken along lines V—V of FIG. 3.

Once the leg-rest receiving assembly 10 is situated as described above, seat cushion 8 is reattached to the seat frame, thereby preventing vertical movement of leg-rest receiving assembly 10 relative to the seat frame. See FIGS. 4 and 5. Leg-rest receiving assembly 10 is thereby securely attached to, and hanging from, the seat frame. Removal of leg-rest receiving assembly 10 from the seat frame is accomplished by reversing the above steps.

Leg-rest assemblies 15, 25 are substantially identical and therefore the description will be in terms of only one. Assembly 15 consists of a leg-rest 16 rotatably attached to tubes 17, 17*a* as shown in FIG. 4. Leg-rest 15 fits into leg-rest receiving assembly 10 so as to support the left leg of a person sitting in wheel chair 7. Tubes 17, 17*a* have a diameter slightly less than the diameter of parallel tubes 20, 20*a*, 20*b*, 20*c*. Although tubes 17, 17*a* are designated as tubes, and are shown cross-sectionally in FIG. 5 as hollow, it should be understood that they may be solid rods.

Parallel tube 20*a* should be situated so that parallel tubes 20 and 20*a* approximately span the width of the right thigh of a person seated in wheel chair 1. Likewise, parallel tube 20*b* should be situated so that parallel tubes 20*b* and 20*c* approximately span at least the width of the left thigh of a person seated in wheel chair 1. Preferably, parallel tubes 20*a* and 20*b* are aligned next to each other midway between parallel tubes 20 and 20*c*. As seen in FIG. 3, tubes 17, 17*a* are rigidly braced at the forward ends thereof by a transversely disposed member 17*b* such that tubes 17, 17*a* are spaced apart so as to be receivable within parallel tubes 20*b* and 20*c* (note that the tubes of leg-rest assembly 25 are receivable within parallel tubes 20 and 20*a*), as shown in FIG. 3.

Equally spaced from tubes 17, 17*a* at predetermined positions are a pair of parallel side brace tubes 17*d*, 17*c*. Side brace tubes 17*c*, 17*d* are joined at their rearward ends by perpendicular brace tube 17*e*. Brace tubes 17*c*, 17*d* and perpendicular tube 17*e* are all arranged in the same geometrical plane and tubes 17*c*, 17*d* extend rearward a predetermined distance, to be described below.

A pair of C-clamps 18, 18*a* rotatably fasten a leg/foot supporting cushion 16 to perpendicular brace 17*e* as by screws 19, or other suitable means. Cushion 16 is of a smaller width dimension than the space between tubes 17, 17*a* and is so positioned above brace 17*e* that less than one-half of its length extends rearward of brace 17*e*. In this manner, when downward pressure is applied to the rear edge of cushion 16, cushion 16 will rotate from a useful position above tubes 17 to a storage position below tubes 17 (as shown in phantom in FIG. 4). Assemblies 15, 25 can then be stored under the seat of wheel chair 7 (as shown in full in FIG. 4).

Figure 6:
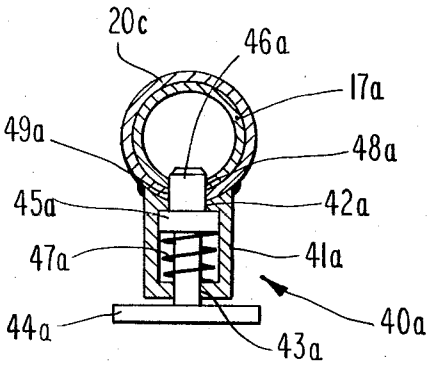
FIG. 6 shows a view taken along lines VI—VI of FIG. 3.

FIG. 6 shows the latching mechanism 40*a* used to secure leg-rest assemblies 15, 25 at various and discreet extended positions. Mechanisms 40, 40*a* extend laterally from, and are permanently joined to, parallel tubes 20, 20*c* respectively (see FIG. 2). Each mechanism 40, 40*a* is similar in construction and operation, so a description of mechanism 40*a* only will be given.

Mechanism 40*a* comprises a housing 41*a* fabricated from material similar to tubes 20, 20*c* and known in the art. Housing 41*a* has apertures 42*a*, 43*a* located at opposite ends to allow a plunger 44*a* to ride therebetween. Aperture 42*a* is aligned with opening 49*a* in tube 20*c*. Plunger 44*a* has a stop 45*a*, in the form of a washer, fixed to the distal end thereof to allow only tip 46*a* to poke through aperture 42*a* and opening 20*c*. An expansion spring 47*a* is coiled around plunger 44*a* between stop 45*a* and housing 41*a* to resist any outward movement of plunger 44*a*. Tube 17*a* has a series of apertures 48*a* (only one shown) that align, serially, with opening 49*a* and aperture 42*a* so as to allow tip 46*a* to extend therethrough to lock tube 17*a* at discreet distances from wheel chair 7. Leg-rest assemblies 15, 25 can thus be adjusted to variously desired positons in front of the occupant.

What is claimed is:

1. A removable leg rest receiving assembly for use in connection with a wheel chair having a back frame connected to a seat frame wherein said assembly is supported by said seat frame and converts said wheel chair into one which includes leg/foot supports comprising:

a plurality of spaced-apart, parallel tubes with at least one said tube having an orifice therethrough oriented in a horizontal plane and having openings at the front ends thereof and being rigidly braced by transversely disposed members;

grasping means fixed to said brace members for removably attaching said assembly to the seat frame;

at least one coaxially-positioned inner tube telescopingly received in a parallel tube and having a plurality of orifices therethrough in sequential alignment with said parallel tube orifice as said inner tube is longitudinally extended;

at least one leg-rest attached to the distal end of said inner tube and rotatable from an inverted, storage position to an upright, cushion position;

a spring-biased bolt in said housing extending through said parallel tube orifice and said inner tube orifice.

* * * * *